US007985143B1

(12) United States Patent
Daxon

(10) Patent No.: US 7,985,143 B1
(45) Date of Patent: Jul. 26, 2011

(54) BOXING RING CORNER MAT

(76) Inventor: Moses F. Daxon, Hallandale, FL (US)

( * ) Notice: Subject to any disclaimer, the term of this patent is extended or adjusted under 35 U.S.C. 154(b) by 560 days.

(21) Appl. No.: 12/009,741

(22) Filed: Jan. 22, 2008

Related U.S. Application Data

(63) Continuation-in-part of application No. 10/800,243, filed on Mar. 12, 2004, now abandoned.

(51) Int. Cl.
*A63C 19/12* (2006.01)
*A63C 19/00* (2006.01)

(52) U.S. Cl. ..... 472/93; 297/217.1; 428/40.1

(58) Field of Classification Search ..... 472/92–94, 472/136, 137; 297/217.1; 428/99, 100, 119, 428/138, 192; 482/83
See application file for complete search history.

(56) References Cited

U.S. PATENT DOCUMENTS

| | | | | |
|---|---|---|---|---|
| 3,786,531 | A * | 1/1974 | Borg | 15/310 |
| 6,177,164 | B1 * | 1/2001 | Sullens et al. | 428/40.1 |
| 6,682,463 | B2 * | 1/2004 | Jackson | 482/83 |
| 2005/0088020 | A1 * | 4/2005 | Munoz | 297/217.1 |

* cited by examiner

*Primary Examiner* — Kien T Nguyen
(74) *Attorney, Agent, or Firm* — Frank L. Kubler

(57) ABSTRACT

A boxing ring corner mat includes a mat body having a mat upper surface; and a pan recess in the mat upper surface and a liquid collecting pan retained within the pan recess for gathering and retaining water and other liquids. The mat preferably additionally includes a spit bucket recess located forwardly of the pan recess and pan and a spit bucket retained within the spit bucket recess in fluid communication with the pan through a bucket drain hose. The mat preferably additionally includes shoe engaging and propping elevations having shoe sole engaging upper surfaces, and preferably additionally includes a separable display region removably fitted into a display region opening in the mat body. The shoe propping elevations optionally are hollow and have upwardly opening air flow ports and each contain a shoe drying fan for blowing a stream of air onto the soles of boxer shoes.

12 Claims, 8 Drawing Sheets

BOXING RING CORNER MAT

FILING HISTORY

This application is based at least in part on the contents of disclosure document number 541197 filed on Oct. 31, 2003, and a continuation-in-part of application Ser. No. 10/800,243 filed on Mar. 12, 2004 now abandoned.

BACKGROUND OF THE INVENTION

1. Field of the Invention

The present invention relates generally to the field of sports equipment. More specifically the present invention relates to a corner mat for placement in a corner of a boxing ring to prevent a boxer and his stool from sliding on the water splashed onto a boxer and spattering onto boxing ring surface, by diverting the water and other liquids into a collection pan, elevating boxer shoes above the mat surface and by drying boxer shoe soles. The mat has a mat body having a mat body perimeter shape which may be generally triangular or generally diamond-shaped but preferably is generally the shape of a sneaker sole. The mat preferably has mat fastening means for securing the mat in place, which preferably are located in a mat anchor corner. The mat fastening means preferably includes a tie string secured to and extending from the mat anchor corner for tying around the ring corner post. The mat includes several boxer anti-slip means including a rough surface for frictionally engaging boxer shoes, and a fluid collecting pan having a pan bottom wall and a pan side wall with a side wall lip and fitted into a pan recess and which preferably receives the lower ends of stool legs to secure a boxer stool against movement relative to the mat and to collect and contain water, sweat and spit. Also provided is a spit bucket, located forward of the pan, the spit bucket being fitted into a bucket recess in the mat upper surface. A bucket drain hose extends from the spit bucket onto the pan along an incline so that liquid enters the drain hose from the bucket and flows into the pan where liquids are collected during a match. A absorbent ring such as of a tissue paper or of sponge material is slidably retained within a circular channel along the outward surface of the pan side wall, and one or more electric ring rotation motors is mounted to the mat adjacent to the pan side wall and rotates a drive cylinder extending into the pan and into contact with the absorbent ring to cause the absorbent ring to rotate within the pan about the center of the pan to gather and absorb collected liquid. A circuit recess preferably is provided in the mat material underneath the pan and under the pan recess, which contains batteries and circuit wiring with a general mat switch connected to and powering the ring rotation motors.

The mat also has shoe engaging and propping elevations having shoe heel supporting portions and shoe sole engaging upper surfaces and which are angled back toward the heel to elevate boxer shoes and feet in a comfortable position. The shoe engaging and propping elevations preferably have the shape of the bottom of a shoe and resemble inverted shoes. The propping elevations preferably are hollow and each contain a shoe drying fan and the sole engaging upper surfaces each have air flow ports to pass air from the fans to the soles of boxer shoes resting on propping elevations to dry moisture from the canvass. The fans are powered by and connected by circuit wires and mat switch to batteries contained within the above-referenced circuit recess. The fan blades preferably are two inch. Brush bristles preferably are provided around the periphery of each propping elevation.

The mat preferably has a separable central display region formed of a sponge material which removably fits into a display region opening in the mat. Normally the entire mat, or at least the display region, would be changed after each fight.

2. Description of the Prior Art

There have long been floor mats for providing enhanced friction between user shoes or feet and a support surface. Yet floor mats are not shaped to fit into and are not provided in boxing ring corners. Furthermore, not all slipping and safety problems in a boxing ring corner could be solved by a conventional shoe gripping floor mat. Water splashed or spattered with a wet towel onto a boxer by his corner crew collects in the corner and would pool on a conventional floor mat to a level beyond its non-slip capacity. In addition, the boxer stool can slide out from under and thereby injure him. This mishap becomes more likely because the boxer must lean back on his stool to comfortably tilt his shoes back on their heels.

Miller, et al., U.S. Pat. No. 3,886,620, issued on Jun. 3, 1975, discloses a door or shoe mat which is made of plastic and has integrally molded upward flexible projections for scraping dirt off shoes and has non-flexible projections for supporting the foot so that the flexible projections are not totally deflected and their resiliency is preserved.

Tupper, U.S. Pat. No. 3,911,520, issued on Oct. 14, 1975, teaches a door mat including upward projections for scraping mud off shoes, and including an upwardly extending perimeter rim surrounding the projections for containing a pool of water to soften mud on shoes for removal.

Shields, U.S. Pat. No. 3,930,084, issued on Dec. 30, 1975, reveals a plastic decorative inlay in a floor mat. The plastic inlay displays embossed advertising indicia and optional colors, and is releasably attached to the central region of the mat within a recess.

McIntosh, U.S. Pat. No. 4,876,135, issued on Oct. 24, 1989, discloses a floor mat with a disposable absorbent pad including having a top sheet with debris passing openings joined along its perimeter to a bottom sheet and having an open edge for inserting replaceable absorbent pads for gathering dirt and debris.

Austin, U.S. Pat. No. 5,456,966, issued on Oct. 10, 1995, teaches an anti-skid floor mat. Austin includes Y-shaped downward projections on its bottom surface to elevate the mat and permit air to pass and keep the area below the mat dry. Austin further includes upwardly extending bores through the mat bottom surface having resilient domed top walls, several of which are depressed by the weight of a person stepping onto the mat, blowing a quantity of air out of the bores and under the mat.

Conrad, et al., U.S. Pat. No. 6,245,697, issued on Jun. 12, 2001, discloses a flexible mat for absorbing liquids and providing a cushioning effect. Conrad includes polymeric foam materials.

Poe, Sr., U.S. Pat. No. 6,455,123, issued on Sep. 24, 2002, teaches a non-slip padded mat for use primarily in automobiles as floor and trunk mats, that is intended to be protected from water and dirt and be easy to clean. Poe, Sr. includes a layer having a carpeted upper surface and other rubber-like padding material covered with a translucent upper elastomeric sheet. The upper elastomeric layer optionally includes downwardly extending projections for engaging the carpeted upper surface of the inner padding layer to prevent relative layer slipping.

Blum, et al., U.S. Pat. No. 6,233,776, issued on May 22, 2001, reveals an advanced floor mat including a cleanable portion and a water dissipation component, a water absorbing component, a cushion component, customized graphics which could take the form of advertising, a transparent cleanable portion, an antibacterial and antifungal composition and fragrance.

Munoz, U.S. Pub. No. 2005/0088020, published on Apr. 28, 2005, discloses a boxing ring corner mat having stool leg receiving recesses.

It is thus an object of the present invention to provide a boxing ring corner mat which is shaped to fit into and to completely cover a boxing ring corner and which provides a high friction, slip-resistant surface with surface elevations or bumps normally protruding above the level of a pool of boxer cooling water splashed and collected on the mat.

It is another object of the present invention to provide such a boxing ring corner mat which includes a central recessed pan for gathering and retaining water and other liquids and for retaining stool leg lower ends so that a boxer stool cannot slide out from under the boxer.

It is still another object of the present invention to provide such a boxing ring corner mat which includes shoe propping elevations for supporting boxer shoes which tilt the boxer shoes back on their heels to provide added comfort and a better rest position for a boxer between rounds, and limit any possible tendency to tilt the stool backward, and which can contain powered fans for drying the soles of boxer shoes.

It is finally an object of the present invention to provide such a boxing ring corner mat which includes an upper surface area for display of an advertisement such as a trademark name or logo, which can be inverted and display an alternative advertisement on an opposing mat surface, or which includes a removable display region for displaying such an advertisement and which also can be inverted to display an alternative advertisement on an opposing mat display region surface, and which is durable and economical to manufacture.

SUMMARY OF THE INVENTION

The present invention accomplishes the above-stated objectives, as well as others, as may be determined by a fair reading and interpretation of the entire specification.

A boxing ring corner mat is provided, including a mat body; and mat fastener for securing the mat body within a boxing ring corner. A boxing ring corner mat is further provided, including a mat body having a mat upper surface; and a pan recess in the mat upper surface and a liquid collecting pan retained within the pan recess for gathering and retaining water and other liquids.

The mat preferably additionally includes a spit bucket recess located forwardly of the pan recess and pan and a spit bucket retained within the spit bucket recess in fluid communication with the pan through a bucket drain hose. The mat preferably additionally includes at least one stool leg engaging recess for receiving the lower end of a boxer stool leg to secure a boxer stool against movement relative to the mat. The mat preferably still further includes shoe engaging and propping elevations having shoe sole engaging upper surfaces, and preferably additionally includes a separable display region removably fitted into a display region opening in the mat body. The fastener preferably includes at least one tie string secured to and extending from the mat body for tying around a ring corner post. The mat body preferably has a peripheral shape which is one of: generally sneaker shaped, generally triangular and generally diamond-shaped. The shoe engaging and propping elevations preferably each have a heel supporting portion and are each angled downwardly toward the heel supporting portion for elevating boxer shoes and feet in a comfortable position. The shoe engaging and propping elevations preferably have substantially the shape of the bottom of a conventional sports shoe. The shoe propping elevations optionally are hollow and have upwardly opening air flow ports and each contain a shoe drying fan for blowing a stream of air onto the soles of boxer shoes.

The mat preferably additionally includes an ornamental design on the display region. The ornamental display optionally includes the image of a boxing glove, where the tie string is mounted to the display region to resemble a boxing glove tie lace, and to protrude beyond the mat body for wrapping around and tying to a boxing ring corner post. The ornamental design alternatively may includes the image of a pair of boxing trunks, and where the tie string is mounted to the display region to resemble a boxing trunk tie string, and to protrude beyond the mat body for wrapping around and tying to a boxing ring corner post. The mat optionally is formed from a liquid styrofoam.

An apparatus is further provided including a boxer stool for placement in a boxing ring corner, the boxer stool having at least one boxer stool leg; a boxing ring corner mat having a mat body; and at least one stool leg engaging recess for receiving the lower end of the at least one boxer stool leg to secure the boxer stool against movement relative to the mat.

A boxing ring corner mat is further provided, including a mat body; and shoe engaging and propping elevations having shoe sole engaging upper surfaces.

A boxing ring corner mat is yet further provided, including a mat body having a display region opening; and a separable display region removably fitted into the display region opening in the mat body.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
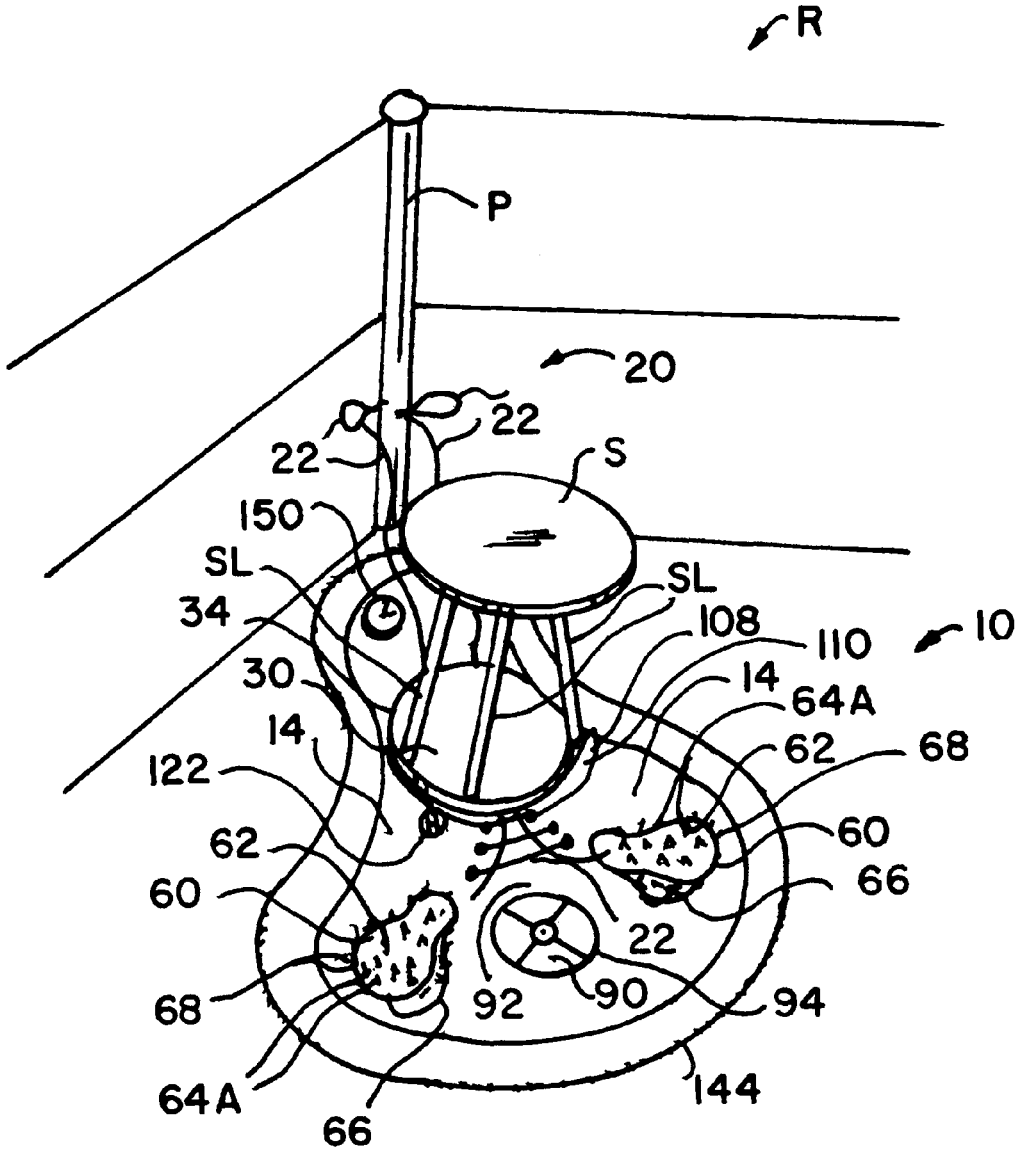
FIG. 1 is a perspective view of the preferred embodiment of the boxing ring corner mat, having a mat periphery shaped as a sneaker sole and having the liquid collecting pan, spit bucket and a timer.
Figure 2:
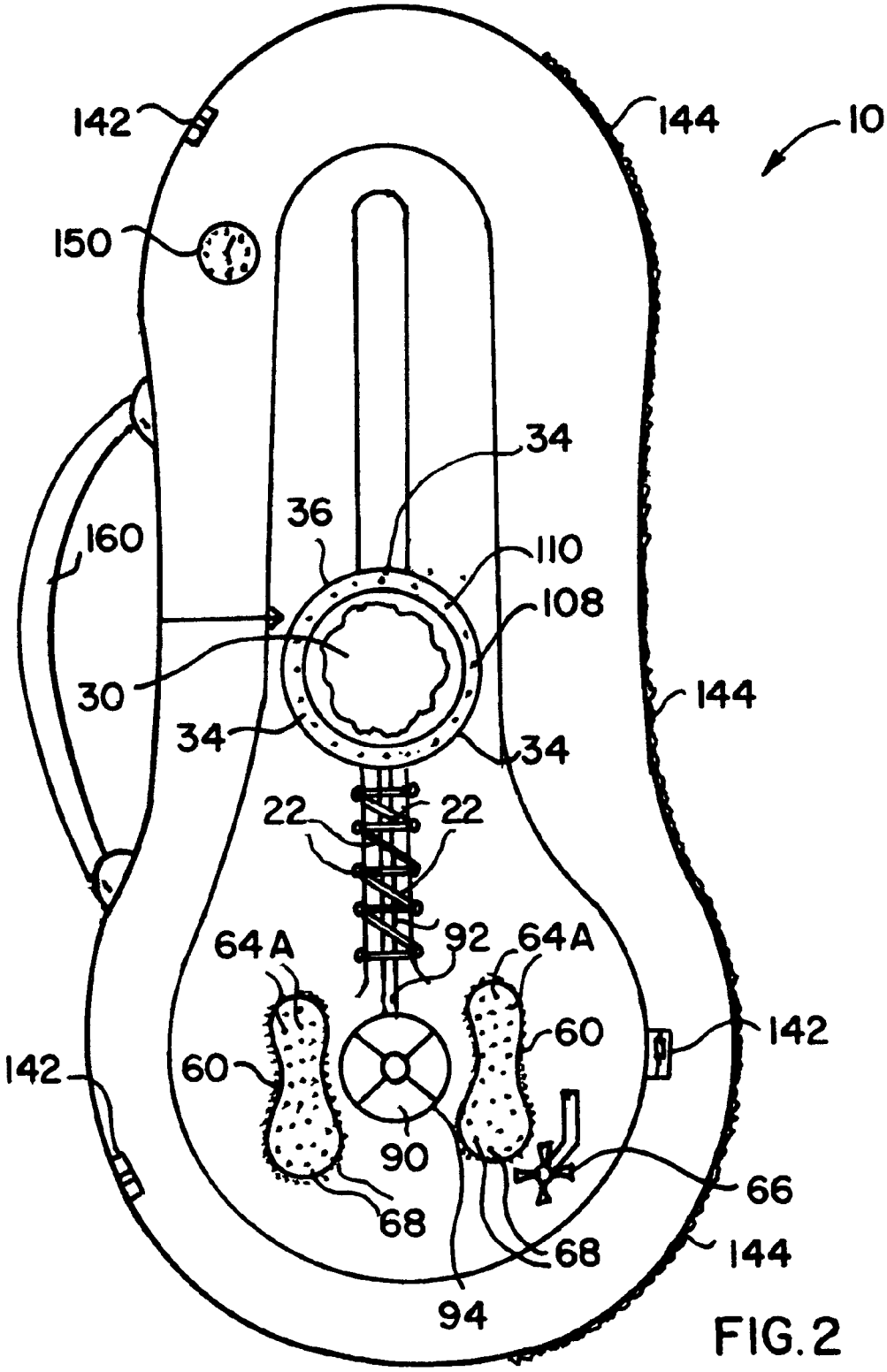
FIGS. 2 and 3 are a top view of the embodiment of FIG. 1.
Figure 3:
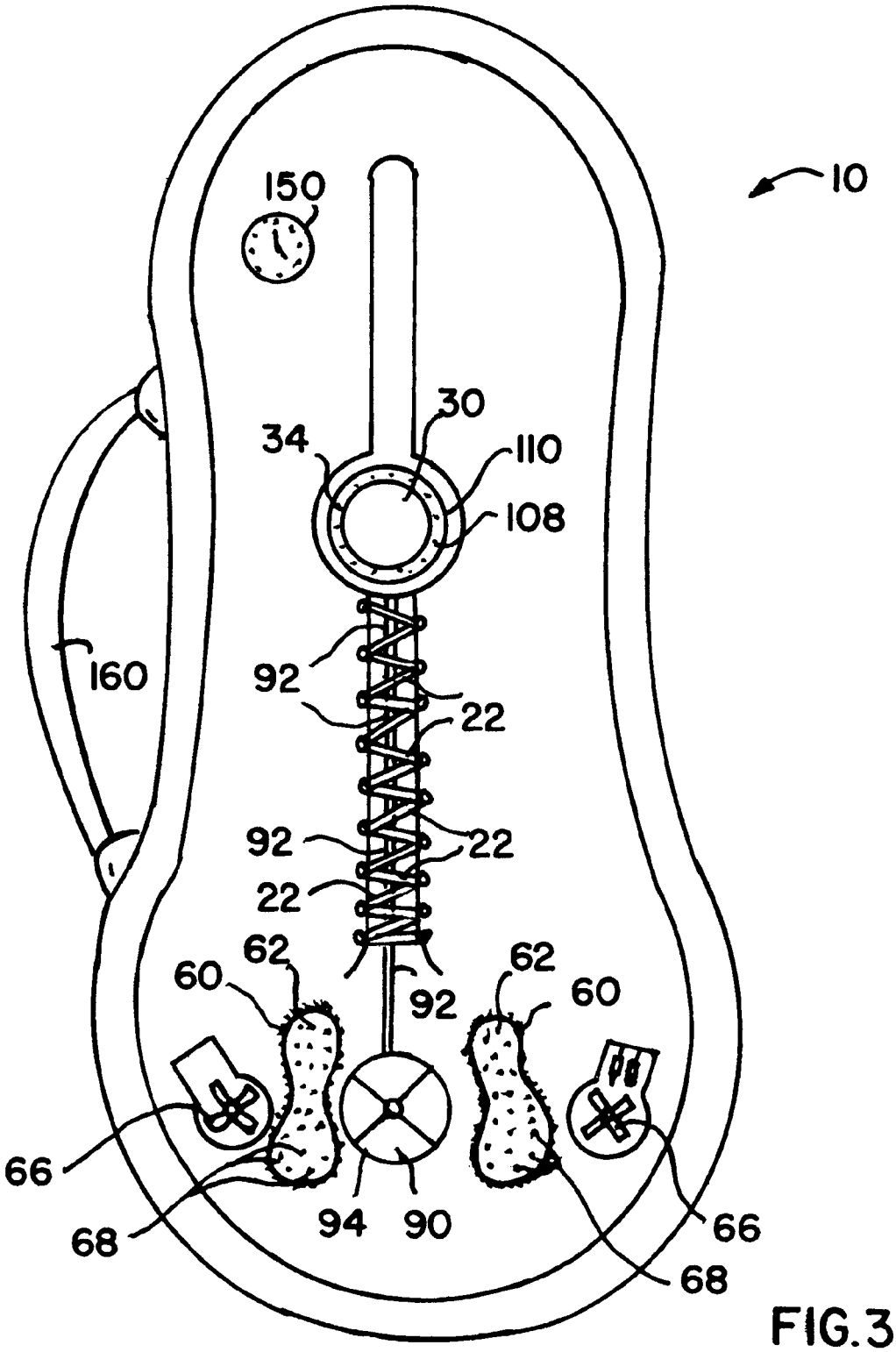
Figure 4:
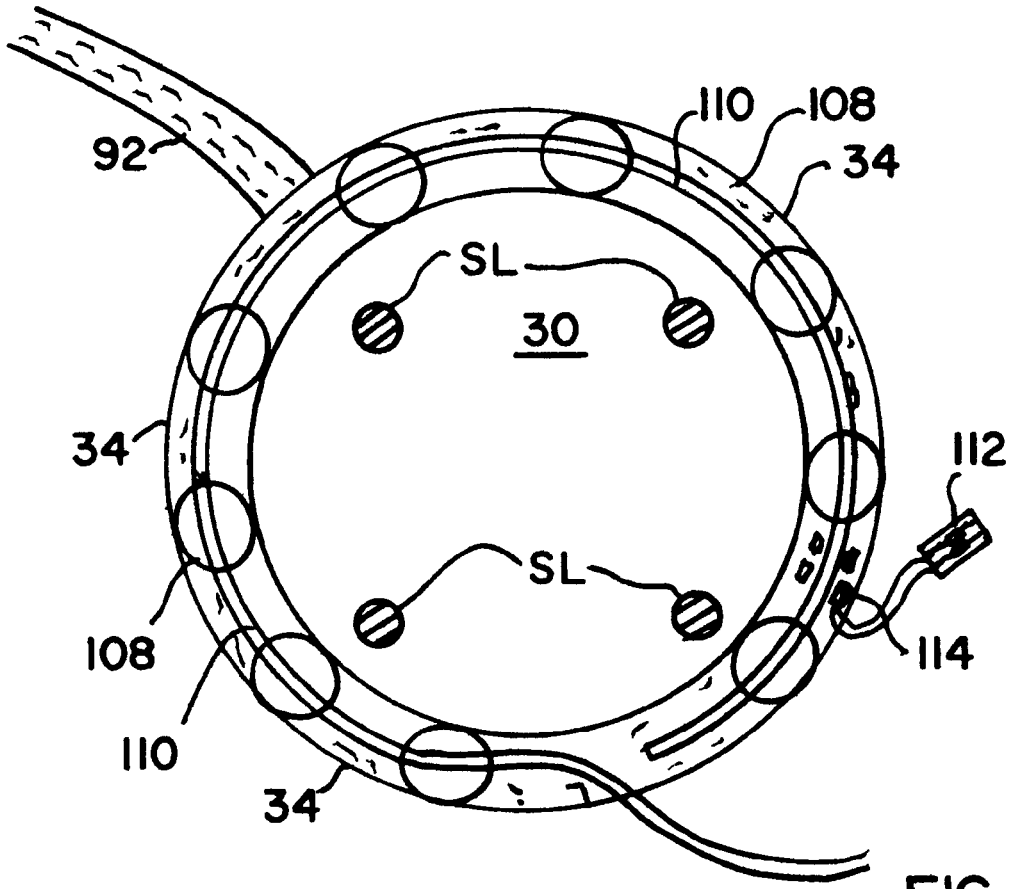
FIG. 4 is a top view of the portion of the mat of FIGS. 1-3 having the pan, showing channel and absorbent ring and ring rotation motors.
Figure 5:
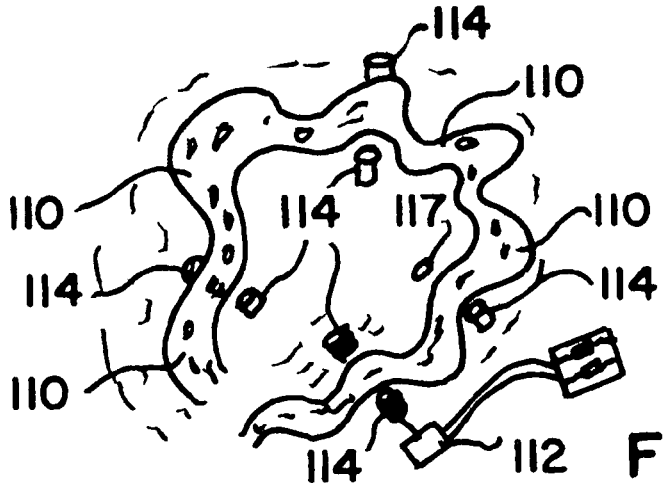
FIG. 5 is a schematic view of the absorbent ring and motors of FIG. 4.
Figure 6:
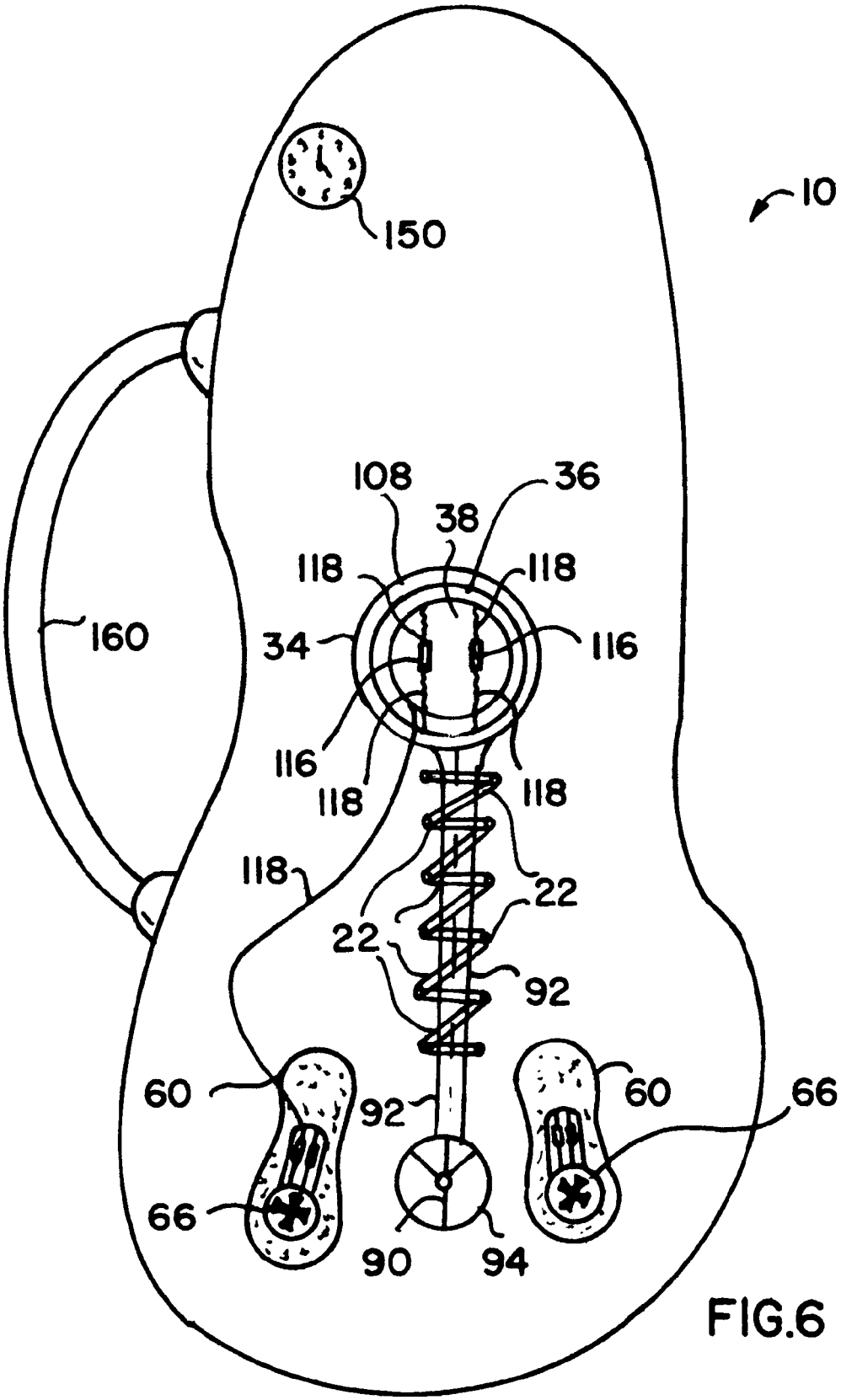
FIG. 6 top view of the mat of FIG. 1 showing the pan removed to reveal the pan recess, batteries and circuit wires.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-12A, a boxing ring corner mat 10 is disclosed for placement in a corner of a boxing ring R. Corner mat 10 has a mat body having a mat body perimeter shape which may be generally triangular or generally diamond-shaped but preferably is generally the shape of a sneaker sole.

Corner mat 10 preferably has mat fastening means 20 for securing the mat 10 in place, which preferably are located in a mat anchor corner 12. The mat fastening means 20 preferably includes a tie string 22 secured to and extending from the mat anchor corner 12 for tying around the ring corner post P.

Corner mat 10 includes several boxer anti-slip means including a rough surface 14 for frictionally engaging boxer shoes, and a fluid collecting pan 30 having a pan bottom wall 32 and a pan side wall 34 with a side wall lip 34A and fitted into a pan recess 36 and which preferably receives the lower ends of stool legs SL to secure a boxer stool S against movement relative to the mat 10 and to collect and contain water, sweat and spit. See FIGS. 1-6. Also provided is a spit bucket 90, located forward of the pan 30, the spit bucket 90 being fitted into a bucket recess 94 in the mat upper surface. A bucket drain hose 92 extends from the spit bucket 90 into the pan 30, is embedded in the mat 10 material and extends along an incline so that liquid enters the drain hose 92 from the bucket 90 and flows into the pan 30 where liquids are collected during a match. An absorbent ring 110 such as of a tissue paper or of sponge material is slidably retained within a circular channel 108 along the inward surface of the pan side wall 34, and one or more electric ring rotation motors 112 is mounted to the mat 10 adjacent to the pan side wall 34 and rotates a drive cylinder 114 extending into the pan 30 and into contact with the absorbent ring 110 to cause the absorbent ring 110 to rotate within the pan 30 about the center of the pan 30 to gather and absorb collected liquid. The circular channel 108 is defined between a the pan side wall 34 and a circular hump in the pan bottom wall 32 spaced radially inwardly from the pan side wall 34. A circuit recess 38 preferably is provided in the mat 10 material underneath the pan 30 and under the pan recess 36, which contains batteries 116 and circuit wiring 118 with a general mat switch 122 connected to and powering the ring rotation motors 112. See FIG. 6.

Corner mat 10 also has shoe engaging and propping elevations 60 having shoe heel supporting portions 62 and shoe sole engaging upper surfaces 64 and which are angled back toward the heel to elevate boxer shoes and feet in a comfortable position. The shoe engaging and propping elevations 60 preferably have the shape of the bottom of a shoe and resemble inverted shoes. The propping elevations 60 preferably are hollow and each contain a shoe drying fan 66 and the sole engaging upper surfaces 64 each have air flow ports 64A to pass air from the fans 66 to the soles of boxer shoes resting on propping elevations 60 to dry moisture from the canvass. The fans 66 are powered by and connected by circuit wires 124 and general mat switch 122 to batteries 116 contained within the above-referenced circuit recess 38. The fan 66 blades preferably are two inch. Brush bristles 68 preferably are provided around the periphery of each propping elevation 60 for a boxer to brush away any debris on the boxer shoes. The spit bucket 90 preferably is located between propping elevations 60.

The mat 10 preferably has a vinyl mat cover 140 which is secured to the mat 10 with snap locks 142 and sealed around the edge of the mat 10 with a peripheral zipper 144. The mat 10 preferably has a one minute timer 150, whether spring or electric powered, embedded in the mat 10 material with the timer face exposed, to the boxer to use during practice. A carrying strap or handle 160 preferably is secured to the mat 10 perimeter.

Mat 10 preferably is formed of foam and vinyl. Pan 30 and bucket 90 preferably are formed of a durable plastic.

Corner mat 10 optionally has a separable display region 70 which removably fits into a display region opening 80 in the mat 10 and has a display region upper surface 72 preferably displaying advertising indicia I such as a trademark or logo. The tie string 22 preferably is mounted to the display region 70 so that the display region 70 can be removed by holding the rest of the mat 10 stationary while pulling the tie string 22. Thus the tie string 22 has two distinct functions and may be used for both functions or for either alone. Corner mat 10 preferably not only includes an upper surface area for display of advertising indicia I but preferably has alternative advertising indicia I on an opposing mat 10 face, so that the mat 10 body can be inverted to display the alternative advertising indicia I. Alternatively, removable display region 70 has an opposing display region face displaying alternative advertising indicia I, so that display region 70 also can be inverted to display the alternative advertising indicia I.

Display region opening 80 preferably is a cavity in the mat 10 having a cavity bottom wall 82 and a cavity peripheral wall 84. The display region 70 can be exchanged for another display region 70 displaying different advertising indicia I. Normally the entire mat 10, or at least the display region 70, would be changed after each fight.

Stool leg engaging recesses 40 optionally are provided and may be holes through or indentations into the mat 10 upper surface outside and around the pan 30, or may be indentations in the pan bottom wall 32. Where the leg engaging recesses 40 are in the display region 70, they preferably pass entirely through the display region 70. Four display region securing protrusions 86 preferably extend upwardly from the cavity bottom wall 82 and register with and fit snugly into the leg engaging recess 40 lower ends. See FIG. 6. The leg engaging recess 40 upper ends preferably are each fitted with a leg retaining cup 42 having an outward radial rim flange 44 which rests on the mat 10 upper surface at the periphery of the recess 40.

Figure 7:
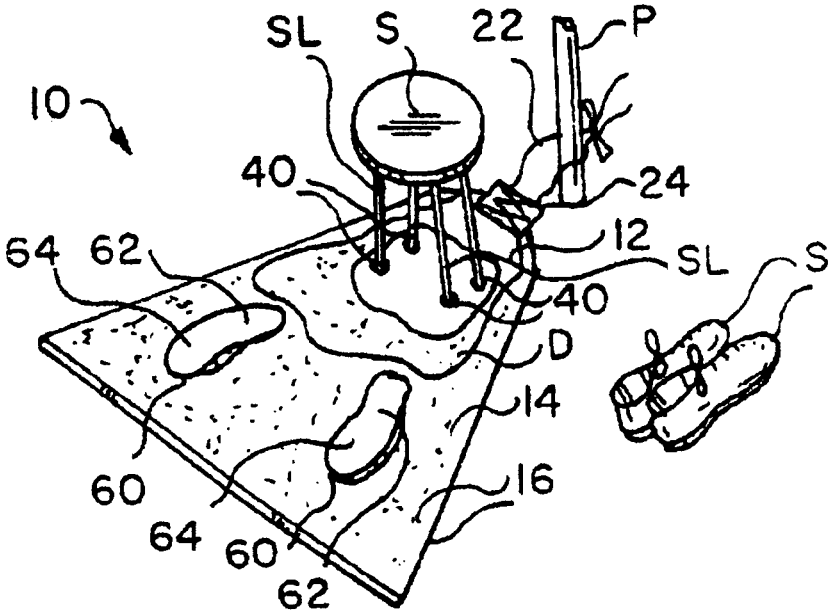
FIG. 7 is a perspective view of another embodiment of the mat having a display region shaped generally as a boxing glove and having shoe engaging and propping elevations in the shape of boxer shoes, and showing a boxer stool on top of the mat with the stool leg lower ends fitted into stool leg engaging recesses and the tie string tied to a boxing ring corner post to secure the mat in a boxer corner.
Figure 8:
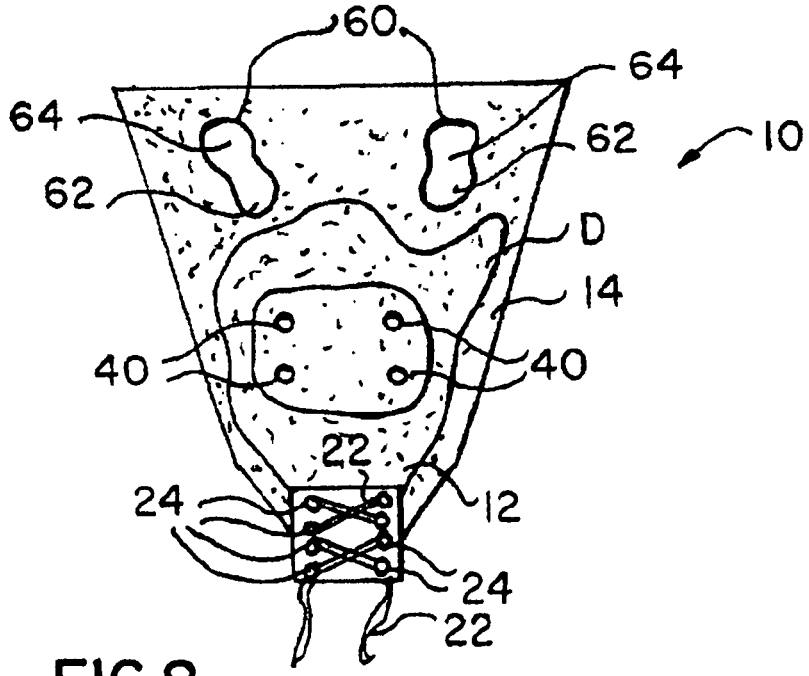
FIG. 8 is a rear perspective view of the corner mat of FIG. 7, omitting the boxer stool.
Figure 9:
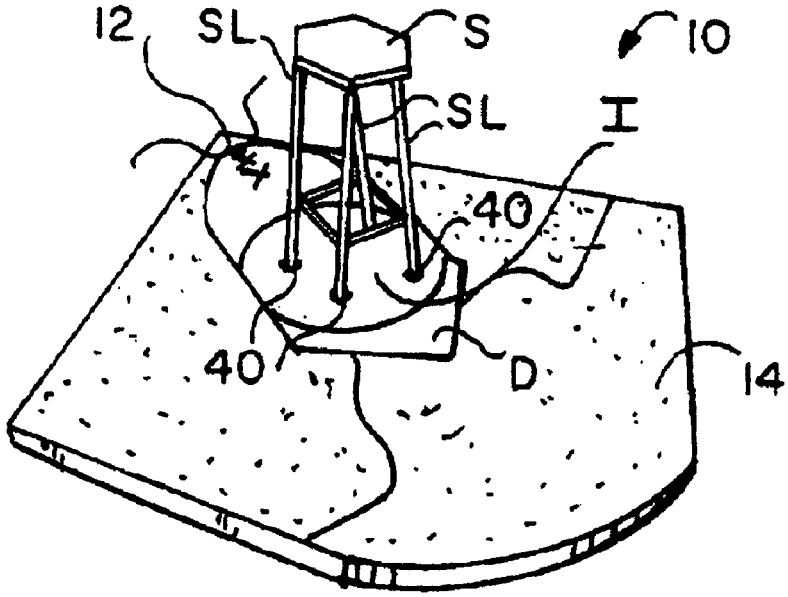
FIG. 9 is a perspective view of another variation of the corner mat of FIG. 7.
Figure 12A:
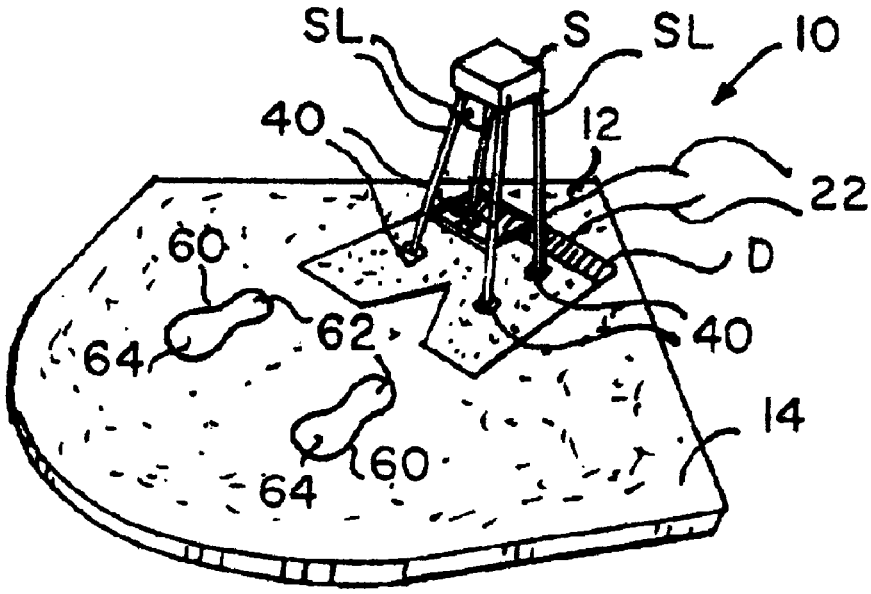
FIG. 12A is a perspective view of another variation of the preferred embodiment of the corner mat of FIG. 12 and the boxer stool, where the display region is shaped and painted to represent a pair of boxing trunks.
Figure 10:
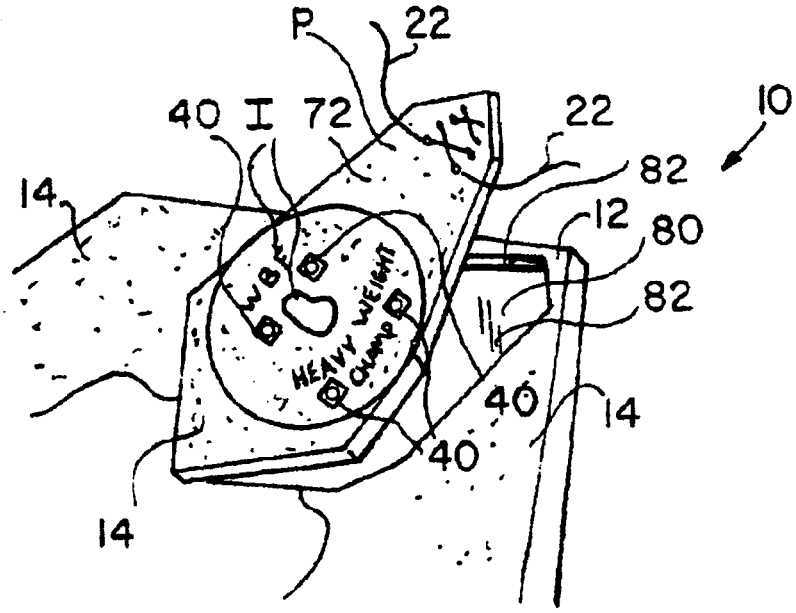
FIG. 10 is a broken away close-up view of the rear portion of the corner mat of FIG. 9, with the display region being lifted out of the display region opening, the display region having advertising indicia on its upper surface.
Figure 12:
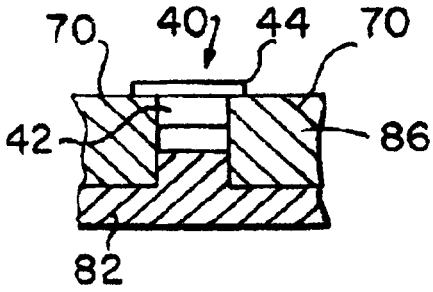
FIG. 12 is a broken away cross-sectional side view of the corner mat and its display region, and of a display region securing protrusion and a leg retaining cup extending into a stool leg engaging recess.
Figure 11:
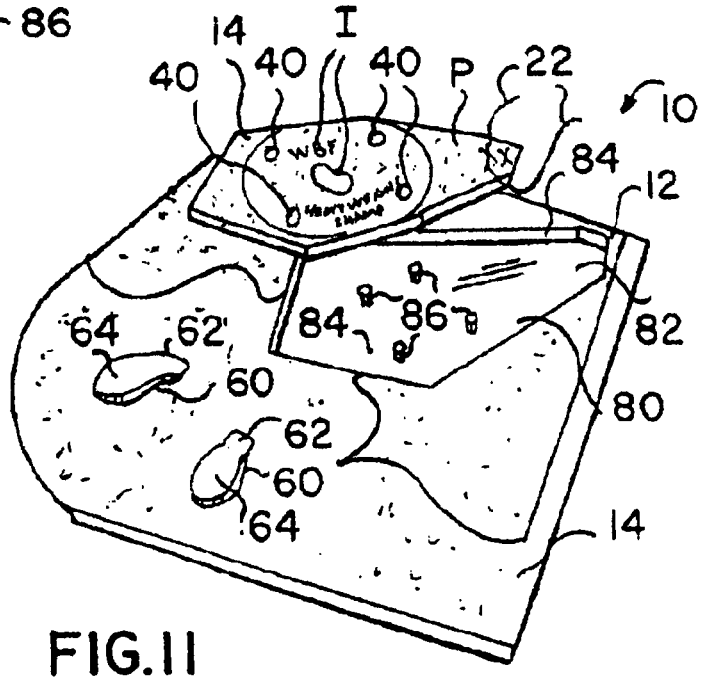
FIG. 11 is a view as in FIG. 10, showing the entire corner mat, with the display region entirely removed from and resting adjacent to the display region opening, revealing the four display region securing protrusions.

The mat display region 70, or the entire mat 10, preferably includes any of a variety of possible ornamental images or designs D. One example is the boxing glove design D on the display region as shown in FIGS. 1-5. For this design D, the tie string 22 is of a type similar to an actual boxing glove tie lace and is molded into and thereby embedded in the mat 10, and preferably into the display region 70 to appear to cross back and forth and across itself through opposing string holes 24 in the wrist portion of the boxing glove design D to resemble a boxing glove tie string, and free ends of the string 22 protruding outwardly beyond the anchor corner 12 for wrapping around and tying to a ring corner post P. An alternative design D shown in FIG. 7 is a pair of boxing trunks. In this instance, the tie string 22 is of a type similar to an actual boxing trunk tie string and once again is molded into mat 10, and preferably into the mat 10 display region 70 to cross back and forth and resemble a boxing trunk tie string. Yet another design D is that of a sports shoe (not shown), the tie string 22 once again being molded into mat 10, and preferably into the display region 70 to cross back and forth across itself to resemble shoe strings.

A layer of high friction sheet material 16 optionally is adhesively bonded to the mat 10 upper and lower surfaces. Corner mat 10 preferably is formed from liquid styrofoam, and specifically a spongy urethane foam. The mat 10 hardness can be selected by controlling the amount of hardener added during manufacture. The display region 70 preferably is formed of a light sponge material.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A boxing ring corner mat, comprising:

a mat body having a mat upper surface;

and a pan recess in a portion of said mat upper surface and a liquid collecting pan retained within said pan recess for gathering and retaining water and other liquids against spreading over the remainder of the mat and for receiving legs of a stool to secure a boxer stool against movement relative to the mat.

2. The mat of claim 1, additionally comprising at least one shoe engaging and propping elevation protruding above said mat upper surface having shoe sole engaging upper surfaces.

3. The mat of claim 2, comprising at least two said shoe engaging and propping elevations, wherein said shoe engaging and propping elevations each have a heel supporting portion and are each angled downwardly toward said heel supporting portion for elevating boxer shoes and feet in a comfortable position.

4. The mat of claim 3, wherein said shoe engaging and propping elevations have substantially the shape of the bottom of a conventional sports shoe.

5. The mat of claim 3, additionally comprising a separable display region removably fitted into a display region opening in said mat body;

wherein said display region has a display region upper surface and wherein said display region upper surface comprises advertising indicia.

6. The mat of claim 3, wherein said at least one pan recess is in the display region.

7. The mat of claim 3, wherein said at least one leg engaging recess passes entirely through said display region.

8. The mat of claim 1, additionally comprising a separable display region removably fitted into a display region opening in said mat body.

9. The mat of claim 1, mat fastening means for securing said mat body within a boxing ring corner; wherein said mat fastening means comprises at least one tie string secured to and extending from said mat body for tying around a ring corner post.

10. The mat of claim 1, wherein said mat body preferably has a peripheral shape which is one of: generally sneaker shaped, generally triangular and generally diamond-shaped.

11. A boxing ring corner mat, comprising:

a mat body having a mat upper surface;

and a pan recess in a portion of said mat upper surface and a liquid collecting pan retained within said pan recess for gathering and retaining water and other liquids;

and a spit bucket recess located forwardly of said pan recess and pan and a spit bucket retained within said spit bucket recess in fluid communication with said pan through a bucket drain hose.

12. A boxing ring corner mat, comprising:

a mat body having a mat upper surface;

a pan recess in a portion of said mat upper surface and a liquid collecting pan retained within said pan recess for gathering and retaining water and other liquids;

and shoe engaging and propping elevations extending above said mat upper surface having shoe sole engaging upper surfaces;

wherein said shoe engaging and propping elevations each have a heel supporting portion and are each angled downwardly toward said heel supporting portion for elevating boxer shoes and feet in a comfortable position;

wherein said shoe engaging and propping elevations have substantially the shape of the bottom of a conventional sports shoe; and wherein said shoe propping elevations are hollow and have upwardly opening air flow ports and each contain a shoe drying fan for blowing a stream of air onto the soles of boxer shoes.

* * * * *